US005573240A

United States Patent [19]

Humboldt

[11] Patent Number: 5,573,240

[45] Date of Patent: Nov. 12, 1996

[54] BASEBALL BACKSTOP FOR PITCHING TRAINING

[76] Inventor: Geoffrey Humboldt, 4343 Grand Ave., Gurnee, Ill. 60031

[21] Appl. No.: 555,280

[22] Filed: Nov. 8, 1995

[51] Int. Cl.[6] ..... A63B 63/00

[52] U.S. Cl. ..... 273/26 A

[58] Field of Search ..... 273/26 A

[56] References Cited

U.S. PATENT DOCUMENTS

| | | | |
|---|---|---|---|
| 2,059,365 | 11/1936 | King | 273/26 A |
| 2,254,986 | 9/1941 | Ziel | 273/26 A |
| 3,013,801 | 12/1961 | Kirkconnell, Jr. | 273/26 A X |
| 3,195,898 | 7/1965 | Respini | 273/26 A X |
| 3,698,712 | 10/1972 | Pero | 273/26 A |
| 3,706,451 | 12/1972 | Dixon | 273/26 A |
| 4,364,562 | 12/1982 | White et al. | 273/26 A |
| 4,497,485 | 2/1985 | Macosko | 273/26 A |
| 4,629,188 | 12/1986 | Mahieu | 273/26 A |
| 4,718,668 | 1/1988 | Schipske | 273/26 A X |

*Primary Examiner*—William H. Grieb
*Attorney, Agent, or Firm*—Thomas R. Vigil

[57] ABSTRACT

The baseball backstop for stopping baseballs thrown at the backstop and for audibly indicating whether a thrown ball has hit the backstop in a strike zone comprises a frame, a netting attached to the frame, a piece of material placed directly in front of the netting and attached to the netting and/or the frame, the piece of material is a relatively heavy deformable piece of material, such that when a thrown ball hits the piece of material, a popping or thumping noise is made by the ball hitting the piece of material indicating that the thrown ball is a "strike", the thrown ball is stopped by the piece of material and falls to the ground in an area proximate to the frame for easy retrieval of the thrown ball, the netting is made of a meshed material such that when a thrown ball hits the netting alone, and not the piece of material, no popping or thumping noise is made indicating that the thrown ball is a "ball" and the thrown ball is stopped by the netting and falls to the ground in an area proximate to the frame for easy retrieval of the thrown ball.

12 Claims, 2 Drawing Sheets

10
12
14
16
18
20
22
24
26
28
30
32
34
36
38
40
42
44
46
48
50
52
54
56
58
60
62
64
65
66
67
68
70
72
74
76

BASEBALL BACKSTOP FOR PITCHING TRAINING

BACKGROUND OF THE INVENTION

1. Field of the Invention

The present invention relates to a baseball backstop for pitching training. More particularly, the present invention is directed to a baseball backstop including a rectangular frame and a netting which is attached to the frame and coveys an area bound by the frame. A piece of material is placed directly in front of the netting and attached to the netting and/or the frame. The piece of material is preferably made of canvass. When a thrown ball hits the canvass, a popping or thumping noise is made by the ball hitting the canvass and indicates to a person that the thrown ball is a "strike". The thrown ball is stopped by the canvass and falls to the ground in an area close to the frame for easy retrieval of the thrown ball.

The netting is made of a finely meshed material so that when a thrown ball hits the netting, the thrown ball is stopped by the netting and falls to the ground in an area close to the frame for easy retrieval. No popping or thumping noise is made, when a ball hits the netting, indicating that the thrown ball is a "ball".

2. Description of the Related Art Including Information Disclosed under 37 CFR §§1.97–1.99

Heretofore, various devices have been proposed to help train a baseball player, especially a pitcher, to throw a baseball accurately and consistently. Several examples of such backstops are disclosed in the following U.S. Patents:

| U.S. Pat. No. | Patentee |
|---|---|
| 4,497,485 | Macosko |
| 4,364,562 | White et al. |

The Macosko U.S. Pat. No. 4,497,485 discloses a baseball pitching target having a rectangular peripheral tubular frame supported by members which are staked to the ground. A mesh backstop is provided across the interior of the frame. The mesh backstop has an insert that represents a catcher's chest protector, shoulder pads, knee pads and mitt. A person throws a ball at the insert. Balls thrown at the insert which are "strikes" are collected in compartmentalized ball receiving bags located in the inset portion of the mesh. Balls thrown at the insert that are "balls" hit the mesh and are projected back toward the pitcher due to a spring action of the mesh backstop.

The White et al. U.S. Pat. No. 4,364,562 discloses a baseball rebound target for training baseball players, particularly pitchers. The device includes a laminated, impact resistant target board which is rigidly attached to a frame structure. The frame structure includes a top cross-bar to which front and rear supporting legs are movably attached. Horizontal cross bars are attached to the front legs and the laminated, impact resistant target board is attached to the horizontal cross bars. A net structure is preferably attached to the frame structure so that thrown balls which miss the target are caught in the net and easily retrieved.

SUMMARY OF THE INVENTION

According to the present invention there is provided a baseball backstop for stopping baseballs thrown at the backstop and for audibly indicating whether a thrown ball has hit the backstop in a strike zone. The backstop comprises a frame, a netting attached to the frame, a piece of material placed directly in front of the netting and attached to the netting and/or the frame. The piece of material is a relatively heavy deformable piece of material, such that when a thrown ball hits the piece of material, a popping or thumping noise is made by the ball hitting the piece of material indicating that the thrown ball is a "strike". The thrown ball is stopped by the piece of material and falls to the ground in an area proximate to the frame for easy retrieval of the thrown ball.

The netting is made of a meshed material such that when a thrown ball hits the netting alone, and not the piece of material, no popping or thumping noise is made indicating that the thrown ball is a "ball" and the thrown ball is stopped by the netting and falls to the ground in an area proximate to the frame for easy retrieval of the thrown ball.

DESCRIPTION OF THE PREFERRED EMBODIMENT(S)

Figures 1, 2:
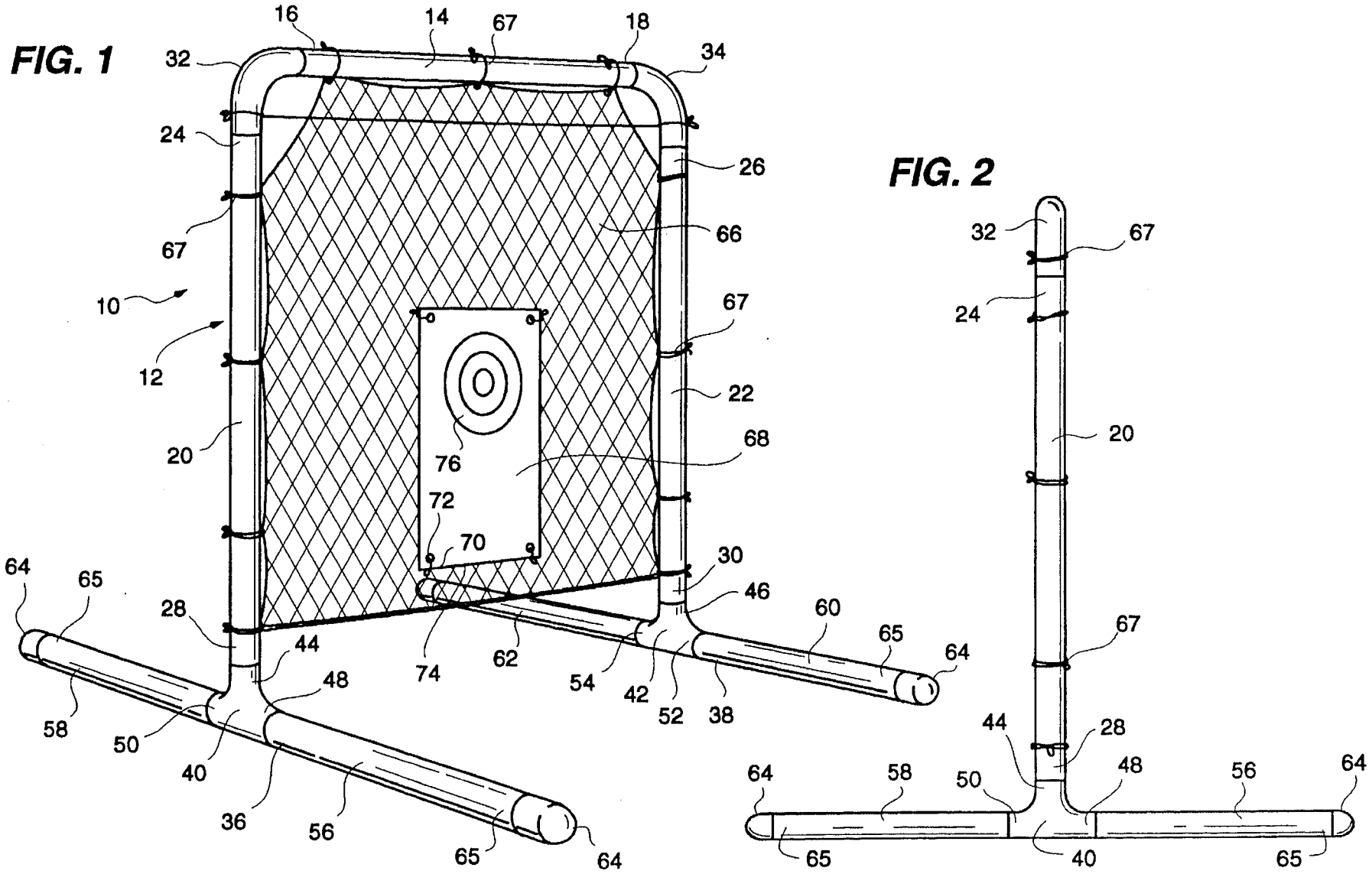
FIG. 1 is a perspective view of a baseball backstop for pitching training constructed according to the teaching of the present invention.
FIG. 2 is a side view of the baseball backstop for pitching training shown in FIG. 1.

While the baseball backstop for pitching training of the present invention is susceptible of several constructions, there is shown in FIGS. 1–4 one preferred embodiment of a baseball backstop constructed according to the teachings of the present invention, with the understanding that the present disclosure is not intended to be limited to the specific constructions illustrated in the drawings.

A perspective view of a baseball backstop 10 for pitching training constructed according to the teachings of the present invention is shown in FIG. 1. The backstop 10 has a rectangular frame 12 which is made of any suitable material, i.e. metal, wood or plastic. One preferred material for the frame is a heavy plastic tubing, commonly known as PVC piping.

The frame includes a horizontal top cross bar 14, made of PVC piping, having a left end 16 and a right end 18. The frame 12 also includes left and right vertical supports 21 and 22 having upper ends 24, 26 and lower ends 28, 30. The upper ends 24, 26 of the left and right vertical supports 20, 22 are connected to the left and right ends 16, 18 of the horizontal top cross bar 14, respectively, at rounded L-shaped joints 32, 34. The L-shaped joints 32, 34 are also made of PVC piping.

The frame 12 also has left and right horizontal bottom supports 36, 38. The left and right horizontal bottom supports 36, 38 are connected to the lower ends 28, 30 of the left and right vertical supports 20, 22, respectively. The bottom supports 36, 38 are connected to the vertical supports 20, 22 transversely of the top cross bar 14.

As shown in FIG. 1, the bottom supports 36, 38 are connected to the vertical supports 20, 22 at T-shaped joints 40, 42 which are also made of PVC piping. Each T-shaped joint 40, 42 has a vertical arm 44, 46 and two collinear arms 48, 50 and 52, 54. The vertical arms 44, 46 of the T-shaped joints 40, 42 receive the lower ends 28, 30 of the vertical supports 20, 22. The collinear arms 48, 50 and 52, 54 of the T-shaped joints 40, 42 receive the horizontal lower supports 36, 38. The horizontal bottom support 36, 38 can be only one piece which slides completely through the collinear arms 48, 50 and 52, 54 of the T-shaped joints 40, 42, extending forwardly and rearwardly or the horizontal bottom supports 36, 38 can be formed of two pieces 56, 58 and 60, 62 each connected to the T-shaped joint 40, 42, one piece 56, 60 extending forwardly from the T-shaped joint 40, 42 and one piece 58, 62 extending rearwardly from the T-shaped joint 40, 42. Caps 64 are placed on outer ends 65 of the bottom supports 36, 38.

The left and right vertical supports 20, 22 are spaced to create a distance between the vertical supports 20, 22 of approximately 36 inches to 72 inches. A preferred distance between the vertical supports 20, 22 is 60 inches.

The horizontal top support 14 is positioned at a distance between of approximately 48 to 84 inches above the ground. A preferred distance between the top support 14 and the ground is 75 inches.

A netting 66 is attached across the area bound by the horizontal top support 14 and the left and right vertical supports 20, 22. The netting 66 can be attached to the frame 12 in any suitable manner. One preferred way of attaching the netting 66 to the frame is by tying pieces of rope or string 67 through the netting 66 and to the top support 14, the left support 20 and the right support 22.

The netting 66 must be made of a finely meshed material such that a thrown baseball will be stopped by the netting 66 and will not pass through the netting 66.

The netting 66 is attached to the frame 12 so that the netting 66 lies in a plane which is generally upright or perpendicular to the ground. When the backstop 10 is placed on a level surface, the netting 66 is at an angle of approximately 90 degrees to the lower horizontal supports 36, 38 or to the surface on which the horizontal supports 36, 38 rest.

Figure 4:
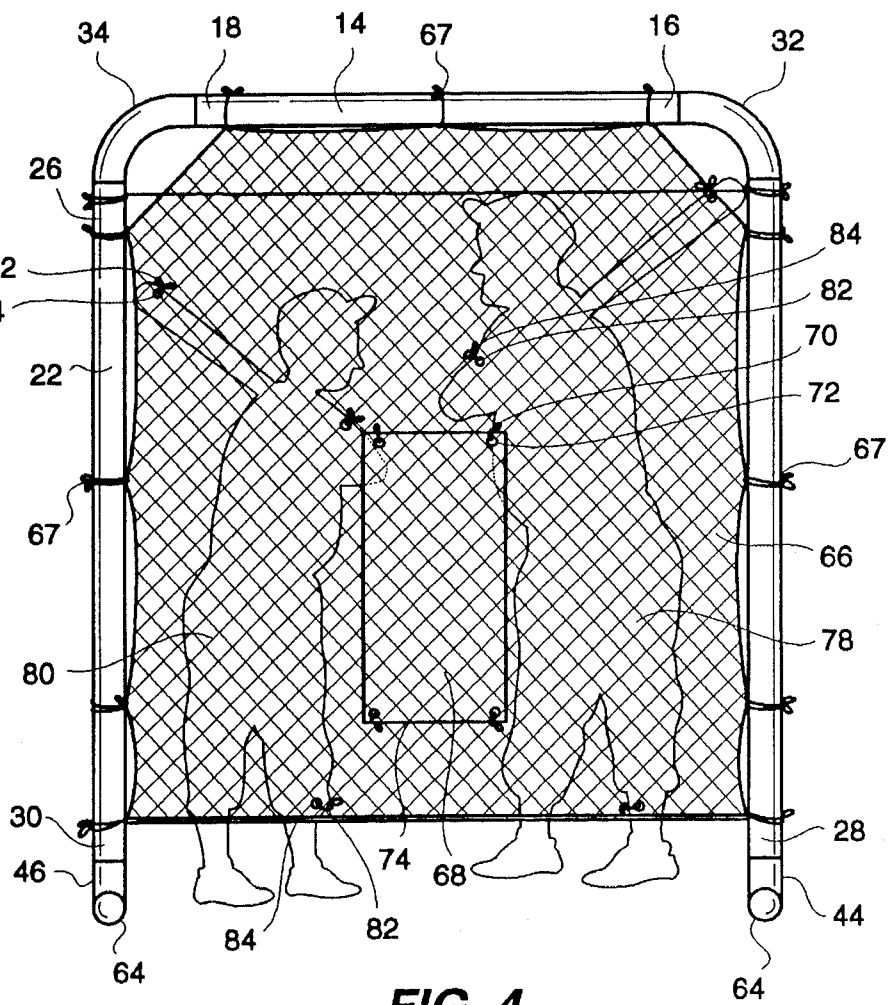
FIG. 4 is a rear view of the baseball backstop for pitching training shown in FIG. 1.
Figure 3:
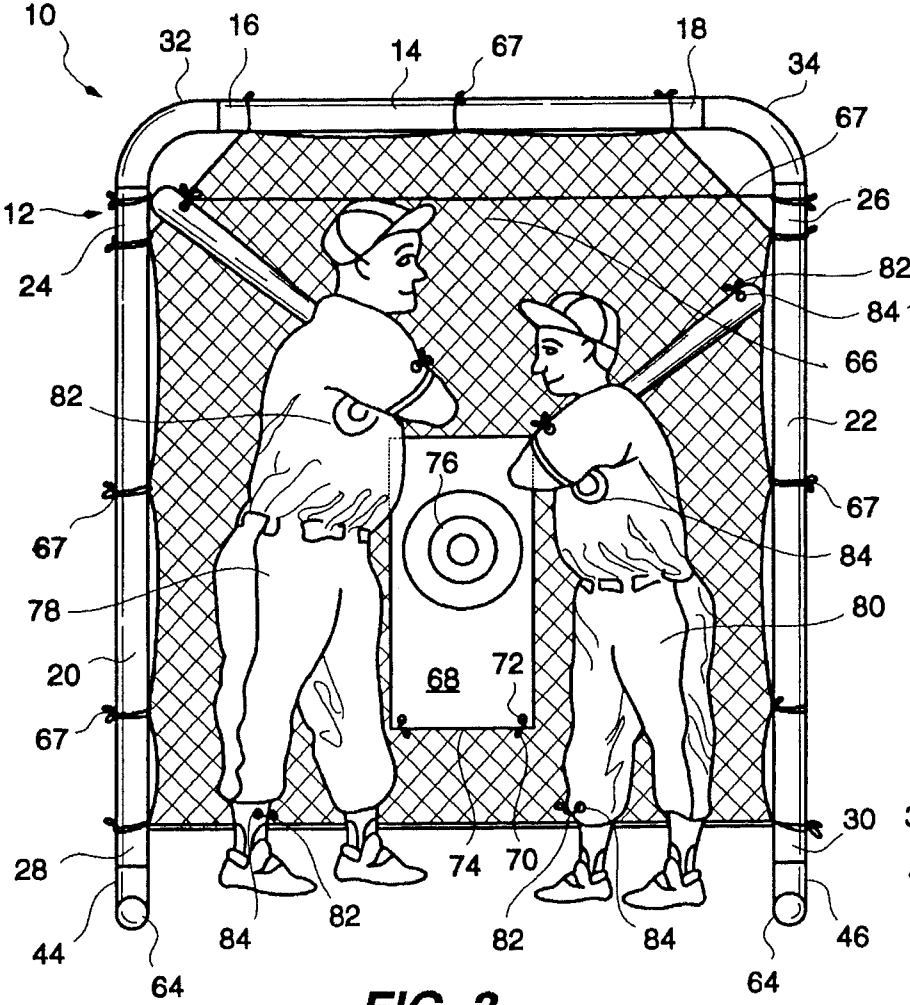
FIG. 3 is front view of the baseball backstop for pitching training shown in FIG. 1 and shows three different pieces of material that can be used with the backstop.

As shown in FIGS. 1, 3 and 4, a rectangular piece of material 68 is shown placed directly in front of the netting 66. The rectangular piece of material 68 can be attached either to the netting 66 or to the frame 12. As shown, the rectangular piece of material 68 is tied to the netting 66 by pieces of rope or string 70 which are inserted through small holes 72 the material and are tied to the netting 66.

The rectangular piece of material 68 is made of a suitable heavy cloth material, one preferred material being canvass. The dimensions of the piece of material 68 preferably approximate the size of a strike zone for an adult or child batter.

As shown, the piece of material 68 has a width of approximately 17 inches to 19 inches. A preferred width is approximately 17 inches, which is the width of a standard home plate used in baseball.

The piece of material 68 also has a vertical height of approximately 20 to 40 inches. The vertical height of the rectangular piece of material 68 can vary within this range depending on the size of the batter a person wishes to practice throwing to. The vertical height approximates the height of a strike zone for a child in a batting stance and an adult in a batting stance, respectively.

A preferred vertical height of the piece of material 68 for an adult batter is 35 inches. A preferred vertical height of the piece of material 68 for a child batter is 25 inches.

The rectangular piece of material 68 can be attached to the netting so that a lower edge 74 of the rectangular piece of material 68 is approximately between 12 inches and 18 inches above the ground. By placing the lower edge 74 of the piece of material 68 at such a height, the lower edge 74 of the piece of material 68 is placed at approximately the height of a lower edge of a strike zone for a child or an adult in a batting stance. A preferred height for the lower edge 74 is approximately 14 inches.

The piece of material 68 also can be of a color that contrasts with an outdoor background. One preferred color is black. The rectangular piece of material 68 can also have indicia 76 thereon, such as a "bull's eye" 76 which is a different color from the rest of the piece of material.

A person can practice pitching by throwing a ball at the backstop 12, aiming for the rectangular piece of material 68 or indicia 76 thereon. If the ball hits the rectangular piece of material 68, an audible "thump" or "pop" sound will be made by the ball hitting the piece of material 68. The audible sound will indicate to the person throwing the ball that he has indeed hit the rectangular piece of material 68 and the thrown ball was a "strike".

The audible "thump" or "pop" sound made by a "strike" is desirable since a pitcher usually stands 60 feet 6 inches from home plate when pitching and it can be difficult to tell, visually, if a thrown ball actually hits the strike zone from such a distance. The difficulty in visually determining where the ball passes through the strike zone is due to the fact that a ball is usually travelling at a high speed and depending on the spin of the ball, the ball can "break" or "rise" just before hitting the strike zone.

If the thrown ball misses the strike zone and therefore the piece of material 68, and simply hits the netting 66, no sound is made and the pitcher knows the thrown ball was not in the strike zone.

The sound made when the ball hits the piece of material 68 is different for balls hitting the piece of material 68 at different speeds. Therefore, a pitcher can also audibly determine whether or not the speed of a pitch, i.e. a fastball, is faster or slower when the uses a particular throwing motion or a particular grip on the ball and can the pitcher can then optimize his throwing motion or adjust his grip, accordingly.

Further, a pitcher can tell if there is a difference in velocity between two different types of pitches, i.e. a fastball and a curveball or a fastball and a change-up. Thus a pitcher can also determine if there is a velocity difference between different types of pitches based on the pitch of the sound created when the thrown ball hits the piece of material 68.

When a thrown ball hits either the netting 66 or the piece of material 68, the ball is stopped and simply falls to the ground near the backstop 10. The ball is not rebounded back toward the pitcher. The ball will fall generally within a small area near the backstop 10 for easy retrieval.

As shown in FIGS. 3 and 4, the backstop 10 can also include a second piece of material 78 in the shape of a silhouette of an adult in a batting stance and/or a third piece of material 80 in the shape of a silhouette of a child in a batting stance. The silhouette pieces of material 78, 80 are also made of a heavy material, preferably canvass.

The second piece of material 78 as shown has indicia 82 thereon to represent an adult in a baseball uniform. The second piece of material 78 can also be a solid color which contrasts from the outdoor background and is different from the color of the first piece of material 68. One preferred color for the second piece of material 78 is red.

Similarly, the third piece of material 80 can also have indicia 84 thereon to represent a child in a baseball uniform.

The third piece 80 of material can also be a solid color which contrasts from the outdoor background, the color of the first piece of material and the second piece of material. One preferred color for the third piece 80 of material is blue.

The second and/or third pieces of material 78, 80 also can be attached to the frame 12 or netting 66 by inserting small pieces of rope 82 through holes 84 the material and tying the pieces of rope 82 to the netting 66.

For more advanced pitching practice, the second and/or third pieces of material 78, 80 provide targets that a pitcher wants to avoid hitting with the ball. The pieces of material 78, 80 are attached to the netting 66, so that a pitcher can simulate throwing a ball just outside of the strike zone, as in a set up pitch, without hitting a batter standing at the plate.

If the pitcher misses the rectangular piece of material. 68 and hits the second or third piece of material 78, 80, a thumping sound is made. However, if the ball misses the rectangular piece of material 68 and also misses the second and third pieces of material 78, 80, no thumping sound is made.

From the foregoing description, it will be apparent that the baseball backstop for pitching training of the present invention has a number of advantages, some of which have been described above and others of which are inherent in the present invention. Accordingly, the scope of the invention is only to be limited as necissitated by the accompayning claims.

I claim:

1. A baseball backstop for stopping baseballs thrown at the backstop and for audibly indicating whether a thrown ball has hit the backstop in a strike zone comprising:

a frame;

a netting attached to said frame;

a first piece of material placed directly in front of said netting and attached to said netting and/or to said frame;

said piece of material being a relatively heavy deformable piece of material, such that when a thrown ball hits said first piece of material, a popping or thumping noise is made by the ball hitting said first piece of material indicating that the thrown ball is a "strike", the thrown ball being stopped by said piece of material and falling to the ground in an area proximate to said frame for easy retrieval of the thrown ball;

said netting being made of a meshed material such that when a thrown ball hits said netting alone, and not said first piece of material, no popping or thumping noise is made indicating that the thrown ball is a "ball" and the thrown ball stopped by said netting falls to the ground in an area proximate to said frame for easy retrieval of the thrown ball.

2. The backstop of claim 1 wherein said first piece of material is rectangular and has dimensions of approximately 17 inches by 30 inches.

3. The backstop of claim 2 wherein a bottom edge of said rectangular piece of material is positioned approximately 12 inches above the ground.

4. The backstop of claim 1 wherein said first piece of material is colored black.

5. The backstop of claim 1 wherein said first piece of material has indicia thereon.

6. The backstop of claim 1 further including a second piece of material, said second piece of material being a relatively heavy deformable piece of material, such that when a thrown ball hits said second piece of material, a popping or thumping noise is made by the ball hitting said second piece of material, said second piece of material being attached to said frame or said netting and being placed directly in front of said netting adjacent said first piece of material, said second piece of material having a shape of a silhouette of an adult batter in a batting stance.

7. The backstop of claim 6 wherein said second piece of material is colored red.

8. The backstop of claim 6 wherein said second piece of material has indicia thereon.

9. The backstop of claim 1 further including a second piece of material, said second piece of material being a relatively heavy deformable material such that when a thrown ball hits said second piece of material, a popping or thumping noise is created by the ball hitting said second piece of material, said second piece of material being attached to said frame or said netting and being placed directly in front of said netting adjacent said first piece of material, said second piece of material having a shape of a silhouette of a child batter in a batting stance.

10. The backstop of claim 9 wherein said second piece of material is colored blue.

11. The backstop of claim 9 wherein said second piece of material has indicia thereon.

12. The back stop of claim 1 wherein said first piece of material is made of canvas.

* * * * *